US011347186B2

(12) United States Patent
Rudaz

(10) Patent No.: US 11,347,186 B2
(45) Date of Patent: May 31, 2022

(54) SYSTEM FOR A WATCH CALENDAR

(71) Applicant: ROLEX SA, Geneva (CH)

(72) Inventor: Denis Rudaz, Segny (FR)

(73) Assignee: ROLEX SA, Geneva (CH)

( * ) Notice: Subject to any disclaimer, the term of this patent is extended or adjusted under 35 U.S.C. 154(b) by 418 days.

(21) Appl. No.: 16/398,734

(22) Filed: Apr. 30, 2019

(65) Prior Publication Data

US 2019/0346813 A1 Nov. 14, 2019

(30) Foreign Application Priority Data

May 9, 2018 (EP) ..... 18171542

(51) Int. Cl.
*G04B 19/253* (2006.01)

(52) U.S. Cl.
CPC ..... *G04B 19/2536* (2013.01)

(58) Field of Classification Search
CPC .. G04B 19/24; G04B 19/253; G04B 19/2536; G04B 19/2538
See application file for complete search history.

(56) References Cited

U.S. PATENT DOCUMENTS

| | | | | |
|---|---|---|---|---|
| 3,716,983 | A | 2/1973 | Tanaka et al. | |
| 2009/0016169 | A1 | 1/2009 | Villar et al. | |
| 2012/0127835 | A1 | 5/2012 | Dubugnon et al. | |
| 2012/0210812 | A1* | 8/2012 | Schmidt | G04B 19/253 74/414 |
| 2014/0301171 | A1 | 10/2014 | Forsey et al. | |
| 2016/0202664 | A1 | 7/2016 | Carreno et al. | |
| 2018/0335755 | A1* | 11/2018 | Kapetanovic | G04B 19/2538 |
| 2019/0286058 | A1* | 9/2019 | Zaugg | G04B 19/25393 |

FOREIGN PATENT DOCUMENTS

| | | | |
|---|---|---|---|
| CH | 385 585G | A3 | 8/1995 |
| CH | 705 737 | A1 | 5/2013 |
| CN | 101441433 | A | 5/2009 |
| CN | 102455653 | A | 5/2012 |
| CN | 105785744 | A | 7/2016 |
| EP | 0 987 609 | A1 | 3/2000 |
| EP | 1 351 104 | A1 | 10/2003 |
| EP | 2 843 483 | A1 | 3/2015 |

OTHER PUBLICATIONS

European Search Report and Written Opinion dated Nov. 14, 2018 issued in counterpart application No. EP18171542; w/ English machine translation (11 pages).
Office Action dated Aug. 18, 2021, issued in counterpart CN application No. 2019103838526, with English translation. (15 pages).

* cited by examiner

*Primary Examiner* — Edwin A. Leon
*Assistant Examiner* — Jason M Collins
(74) *Attorney, Agent, or Firm* — Westerman, Hattori, Daniels & Adrian, LLP

(57) ABSTRACT

A system (1) for a watch calendar includes: a first wheel (3); a first finger (5*b*) for driving the first wheel; a tooth (31*b*) for driving the first wheel, the tooth being movably mounted on the first wheel (3) between a retracted position and a driving position; and a desmodromic system (2, 4) having a cam (2) and a cam follower (4), the desmodromic system being arranged in such a way that at least a first position of the cam defines a first position of the follower permitting the retraction of the tooth, and that at least a second position of the cam defines a second position of the follower preventing the retraction of the tooth.

24 Claims, 9 Drawing Sheets

SYSTEM FOR A WATCH CALENDAR

This application claims priority of European patent application No. EP18171542.6 filed May 9, 2018, the content of which is hereby incorporated by reference herein in its entirety.

The invention relates to a system for a watch calendar. It also relates to a movement comprising a suchlike system. It further relates to a timepiece, in particular a wristwatch, comprising a suchlike system or a suchlike movement. Finally, it relates to a method of operation of a suchlike system for a watch calendar, of a suchlike movement or of a suchlike timepiece.

Mechanisms for annual or perpetual calendars are familiar from the prior art. Suchlike mechanisms generally include one or a plurality of calendar driving devices configured to overcome the torques produced by different return springs or indexation springs involved in the different display and/or programming devices of the calendar.

The programming cams of annual or perpetual calendars are generally provided in order to actuate a movable lever, in particular a movable tooth of a toothing of a calendar wheel or a movable finger of a calendar driving device.

By way of example, patent application EP0987609 discloses a programming cam of an annual calendar provided in order to control a lever pivoting a calendar driving wheel, which is biased by a return spring. A suchlike construction requires a large number of component parts, in particular springs and levers, and consumes a lot of energy. Furthermore, because of the sequencing of the operation of a suchlike mechanism, it is very difficult to achieve a perfectly instantaneous date change of the calendar at the end of a short month.

Patent application CH685585 discloses a mobile tooth of a calendar day wheel, which is biased elastically against a programming cam disposed concentrically with the calendar day wheel. In order to do this, the movable tooth includes a return spring provided in order to bias said tooth against the cam. Furthermore, the programming cam is indexed angularly by an elastic jumper. Both of these springs are actuated by a calendar driving device, which requires additional energy in order to overcome the resistive torque produced by said springs.

U.S. Pat. No. 3,716,983 discloses a construction of which the operating principle is similar to that of the device in application CH685585. The calendar day wheel is in the form of a calendar day disk provided with internal toothing, of which a movable tooth is operated by a programming cam by means of an intermediate lever. The movable tooth is biased elastically by a wire spring disposed on the calendar day disk. In addition to the aforementioned disadvantages, a suchlike construction is complicated in its implementation.

The aim of the invention is to make available a calendar system to address the disadvantages mentioned previously and to improve the systems for a watch calendar that are familiar from the prior art. In particular, the invention proposes a system for a watch calendar that is compact, reliable, simple and minimizes the energy losses in operation.

A calendar system according to the invention is defined by point 1 below.

1. A system (1) for a watch calendar, the system comprising:
   a first wheel (3);
   a first finger (5*b*) for driving the first wheel;
   a tooth (31*b*) for driving the first wheel, the tooth being movably mounted on the first wheel (3) between a retracted position and a driving position;

a desmodromic system (2, 4) comprising a cam (2) and a cam follower (4),
   the desmodromic system being arranged in such a way that at least a first position of the cam defines a first position of the follower permitting the retraction of the tooth, and that at least a second position of the cam defines a second position of the follower preventing the retraction of the tooth.

Different embodiments of the calendar system are defined by dependent points 2 to 11 below.

2. The system (1) for a watch calendar as defined in the preceding point, wherein the follower, the tooth and the first finger are arranged and/or are configured in such a way that, in the driving position of the tooth, the first finger exerts, on the tooth, a mechanical action retracting the tooth or driving the first wheel.
3. The system (1) for a watch calendar as defined in one of the preceding points, wherein the tooth is pivoted on the first wheel about a first axis (A31) or wherein the tooth is mounted in sliding engagement on the first wheel.
4. The system (1) for a watch calendar as defined in one of the preceding points, wherein the system comprises a framework (99) and wherein the follower is a lever pivoted on the framework about a second axis (A4) or the follower is a slider mounted in sliding engagement on the framework.
5. The system (1) for a watch calendar as defined in one of the preceding points, wherein the follower comprises a flank (4*a*) arranged in such a way as to prevent, in particular to prevent by positive engagement, the retraction of the tooth when the follower is in the second position.
6. The system (1) for a watch calendar as defined in one of the preceding points, wherein the first wheel is a calendar day wheel, in particular a calendar day disk, and/or wherein the cam is a crown or a wheel comprising a groove (20) and the follower comprising a pin or a peg (40) housed in the groove and/or wherein the cam is a crown or a wheel comprising a rib and the follower comprising a pin or a peg equipped with a slot, the rib being housed in the slot.
7. The system (1) for a watch calendar as defined in one of the preceding points, wherein the follower comprises first abutments cooperating with second abutments provided on a framework in such a way as to limit the travel of the follower between the first and second positions, and/or wherein the tooth comprises third abutments cooperating with fourth abutments provided on the first wheel in such a way as to limit the travel of the tooth between the retracted position and the driving position.
8. The system (1) for a watch calendar as defined in one of the preceding points, wherein the first wheel comprises a toothing (30) having 31 teeth, and/or wherein the system comprises a second driving wheel (5), of which a second finger (5*a*) is arranged in such a way as to drive the first wheel (3).
9. The system (1) for a watch calendar as defined in the preceding point, wherein the second driving wheel (5) comprises the first finger (5*b*).
10. The system (1) for a watch calendar as defined in one of the preceding points, wherein the system comprises an intermediate wheel (9) arranged in such a way that the cam is driven by the movement of the first wheel, the intermediate wheel comprising elements of the kinematic connection of the cam to the first wheel, in particular a first toothing cooperating with a toothing (22) of the cam and a second toothing cooperating with a toothing (32) of the first wheel.

11. The system (1) for a watch calendar as defined in one of the preceding points, wherein the cam comprises elements for the display of information pertaining to the month, in particular characters and/or a decal intended to cooperate with a dial, in particular one or a plurality of apertures of the dial.

A watch movement according to the invention is defined by point 12 below.

12. A watch movement (200) comprising a system as defined in one of the preceding points.

A timepiece according to the invention is defined by point 13 below.

13. A timepiece (300), in particular a wristwatch, comprising a system (100) as defined in one of points 1 to 11 and/or a watch movement as defined in point 12.

A method of operation of a calendar system according to the invention is defined by point 14 below.

14. A method of operation of a system for a watch calendar as defined in one of points 1 to 11 or of a watch movement as defined in point 12 or of a timepiece as defined in point 13, the method comprising the following stages:

action of the cam (2) on the follower (4) in such a way as to cause it to pass from the first position to the second position, and action of the cam (2) on the follower (4) in such a way as to cause it to pass from the second position to the first position.

A mode of implementation of the method of operation is defined by dependent point 15 below.

15. The method of operation of a system for a watch calendar as defined in the preceding point, wherein, when the follower is in the second position, the first finger exerts, on the tooth a mechanical action for driving the first wheel and wherein, when the follower is in the first position, the first finger exerts on the tooth, a mechanical action for the retraction of the tooth without driving the first wheel.

The figures annexed hereto represent, by way of example, two embodiments of a timepiece incorporating a calendar system.

Figure 1:
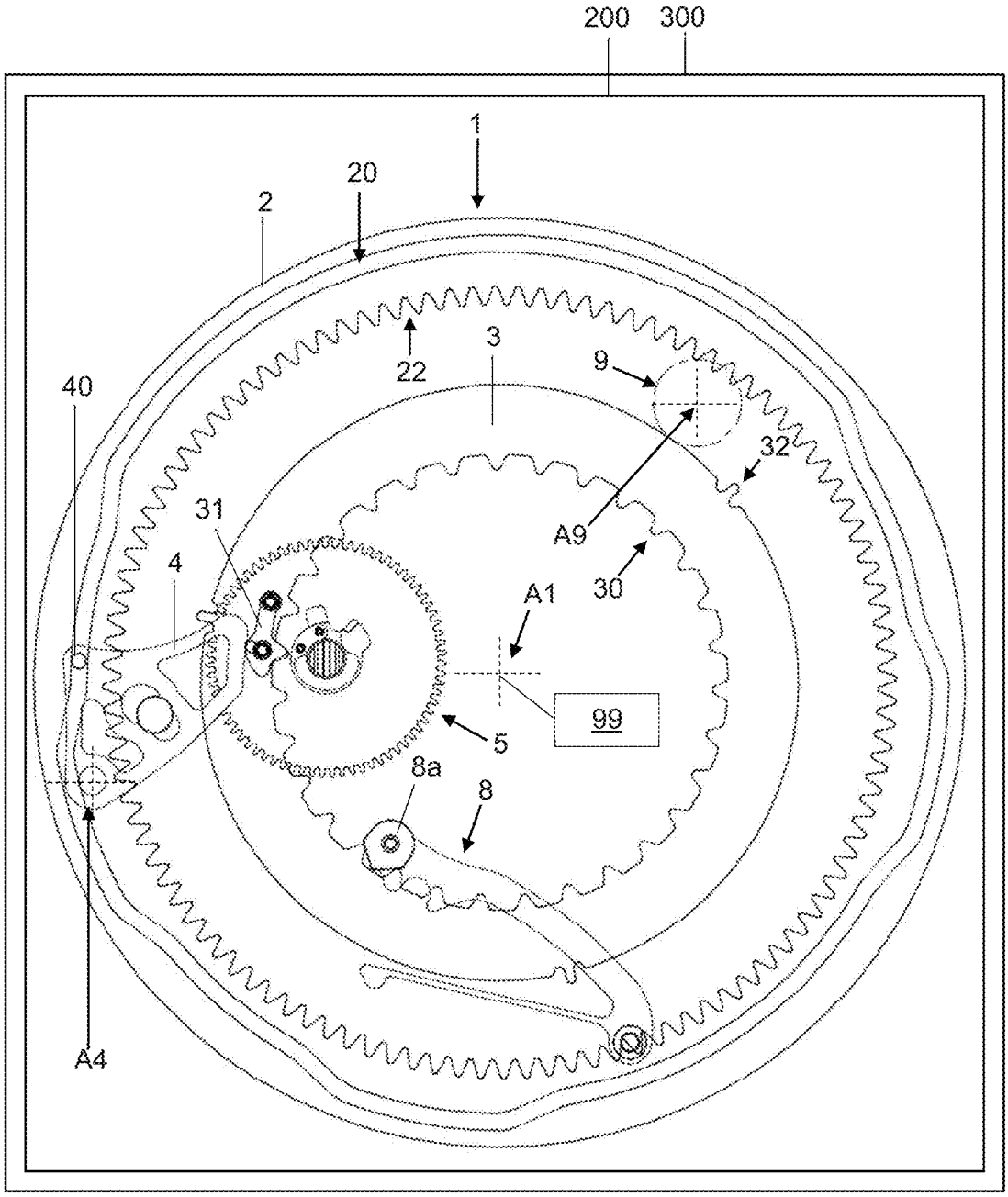
FIGS. 1 to 8 represent a first embodiment of a timepiece.

A first embodiment of a timepiece 300 is described below with reference to FIGS. 1 to 8. The timepiece is advantageously a watch, for example a wristwatch. The timepiece comprises a watch movement 200.

The watch movement may be of the electronic type or of the mechanical type, in particular of the automatic type. The watch movement comprises a system 1 for a watch calendar. The calendar system is of the annual type or of the semi-perpetual type or of the perpetual type, for example. The watch movement and/or the calendar system comprises a framework 99.

The system for a watch calendar comprises:

a first wheel 3;

a first finger 5*b* for driving the first wheel;

a tooth 31*b* for driving the first wheel, the tooth being movably mounted on the first wheel 3 between a retracted position and a driving position; and a desmodromic system 2, 4 comprising a cam 2 and a cam follower 4.

The desmodromic system is arranged in such a way that at least a first position of the cam defines a first position of the follower permitting the retraction of the tooth, and that at least a second position of the cam defines a second position of the follower preventing the retraction of the tooth. Thus, a displacement of the cam from a first cam position to a second cam position may bring about a displacement of the follower from a first follower position to a second follower position, and a displacement of the cam from the second cam position to the first cam position may bring about a displacement of the follower from the first follower position to the second follower position.

The first wheel 3 is a calendar day wheel, for example, in particular a calendar day disk. The first wheel is pivoted on the framework about an axis A1, for example an axis A1 at the center of the movement. The first wheel comprises information pertaining to the calendar days, for example, intended to be indicated to the wearer of the timepiece when the information appears, for example, at the level of the dial through an aperture.

The first wheel advantageously comprises a toothing 30 having 31 teeth. This toothing may be internal toothing. This toothing is disposed, for example, according to a plane P1 depicted in FIG. 11. This plane P1 is the plane of the first wheel, for example, in particular the plane of the disk 3.

Advantageously, the calendar system comprises a jumper 8 cooperating with the first wheel in order to index the first wheel into a position relative to the framework. Preferably, the jumper 8, in particular a head or a nose 8*a* of the jumper 8, cooperates with the toothing 30 in order to index the first wheel.

The tooth 31*b* for driving the first wheel is pivoted, for example, on the first wheel about an axis A31.

Figure 11:
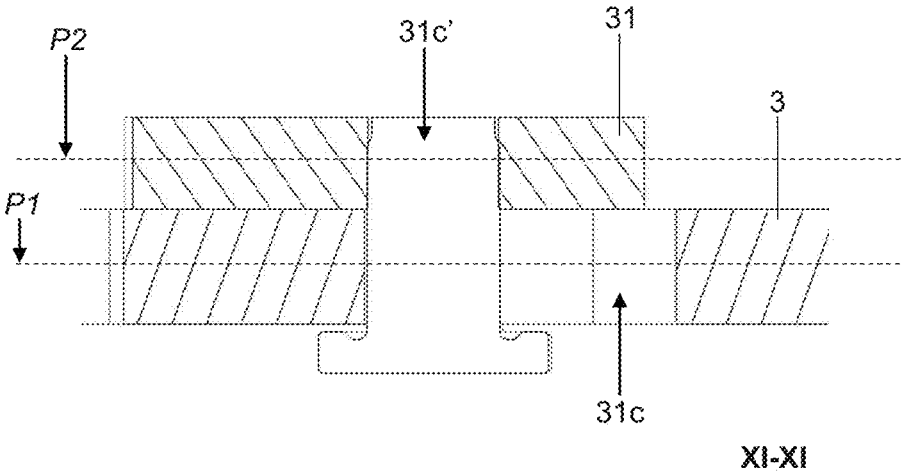
FIG. 11 is a partial section of an illustrative embodiment of a calendar wheel according to a plane XI-XI depicted in FIG. 4.

The driving tooth 31*b* is disposed, for example, according to a plane P2 depicted in FIG. 11. This plane P2 is a plane parallel to the plane P1 and/or parallel to the first wheel, for example.

The driving tooth 31*b* may be implemented on a retractable finger 31. In this case, the retractable finger 31 is pivoted, for example, on the first wheel about the axis A31.

The axis A31 is, for example, parallel or substantially parallel to the axis A1.

The driving tooth 31*b* and/or the retractable finger 31 is thus pivotably movable between a first retracted position and a second driving position.

Figure 4:
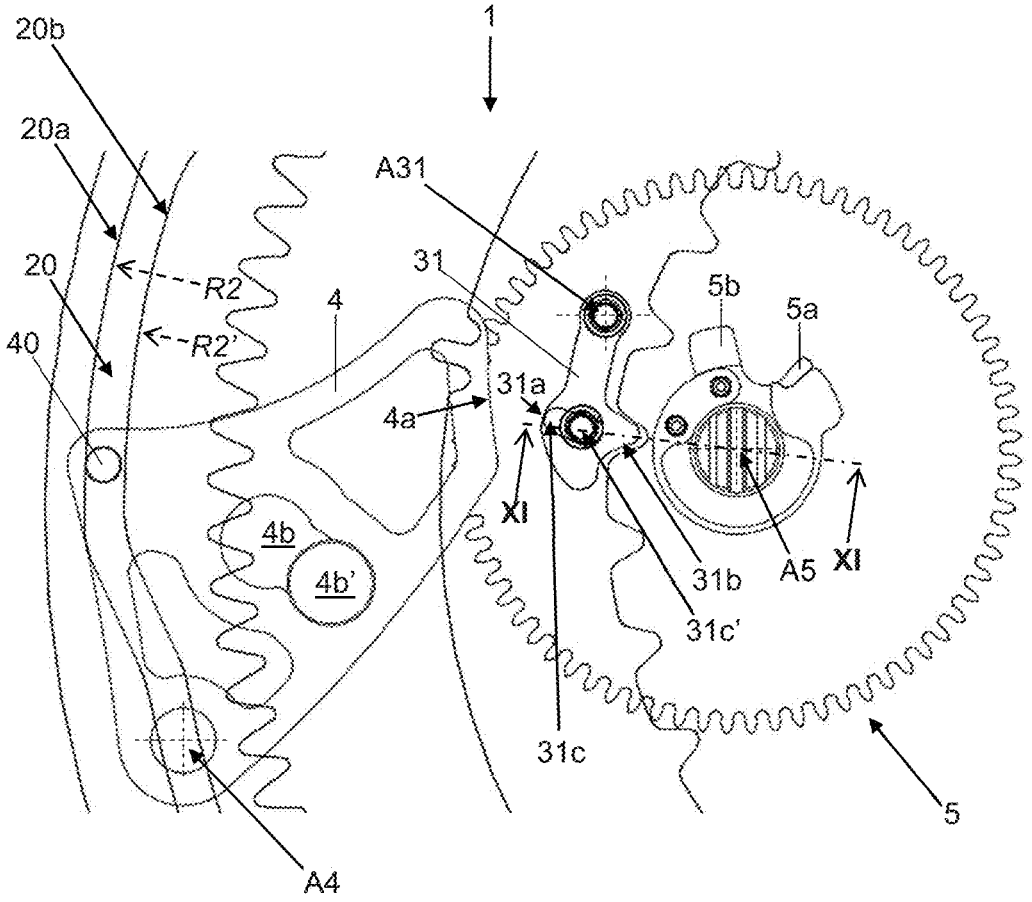

Advantageously, the retractable finger 31 and/or the driving tooth 31*b* may be provided, as depicted in FIG. 4, with guiding means and/or abutment means comprising, for example, at least one groove 31*c* formed on the first wheel and at least one pin 31*c*' attached to the driving tooth 31*b* or to the retractable finger 31. As an alternative, for example, the guiding means and/or the abutment means may comprise at least one groove 31*c* formed on the driving tooth 31*b* or on the retractable finger 31 and at least one pin 31*c*' attached to the first wheel. Thus, the travel of the driving tooth 31*b* and/or of the finger 31 may be guided and/or limited between the retracted position and the driving position.

The system for a watch calendar comprises a wheel 5 for driving the first wheel 3. This driving wheel 5 has the function of driving the first wheel 3 by one step every 24 hours, and possibly by a plurality of steps at the end of the short months. The wheel 5 for driving the first wheel 3 is pivoted, for example, about an axis A5 on the framework. The axis A5 is parallel or substantially parallel to the axis A1, for example, and/or to the axis A31. This driving is preferably of the type with an instantaneous date change. As an alternative, the driving may be of the dragging type.

In order to achieve this driving, the driving wheel comprises the first finger 5*b* for driving the first wheel 3. This first driving finger 5*b* is thus arranged in such a way as to cooperate with the first wheel 3, in particular with the driving tooth 31*b*. In order to do this, for example, all or part of the first driving finger 5*b* is present in the plane P2.

Figure 7:
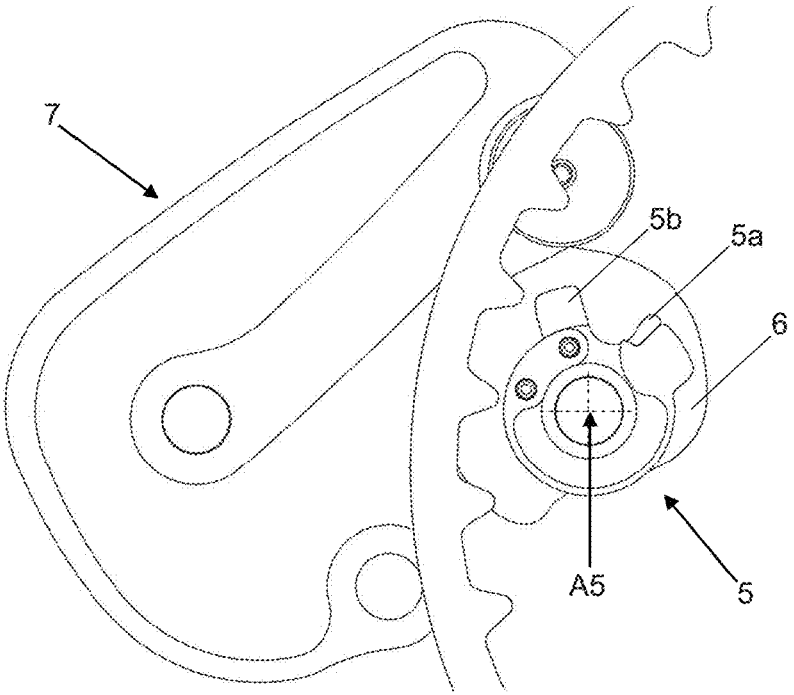

Advantageously, the first driving finger 5*b* is integral with a calendar cam 6 cooperating with an elastic calendar lever 7, as depicted in FIG. 7. The cooperation of the lever 7 and the cam 6 permits the instantaneous rotation of the driving wheel 5, in particular the instantaneous rotation of the driving wheel 5 by a full revolution about the axis A5. This makes it possible to drive the first wheel 3 by an angular step when the first driving finger 5*b* cooperates with the tooth 31*b* for driving the first wheel 3. A suchlike cooperation takes place at the end of the short months, that is to say at the end of months of 30 days or fewer.

Advantageously, in order to achieve driving of the first wheel 3, the driving wheel likewise comprises a second finger 5*a* for driving the first wheel 3. This second driving finger 5*a* is thus arranged in such a way as to cooperate with the first wheel 3, in particular with the toothing 30. In order to do this, the second driving finger 5*a* is present, for example, in the plane P1.

Advantageously, the second driving finger 5*a* is integral with the calendar cam 6. Thus, the second driving finger 5*a* performs, every 24 hours, an instantaneous or quasi-instantaneous rotation by a full revolution about the axis A5. This makes it possible to drive the first wheel 3 by an angular step every 24 hours. The indication of the calendar date may thus be updated every 24 hours.

This results in driving an angular step of the first wheel at the end of the long months by the action of the single second driving finger 5*a*, and in driving of two angular steps of the first wheel at the end of the short months by the actions of the first driving finger 5*b* and of the second driving finger 5*a*, in particular by the action of the first driving finger 5*b* and then that of the second driving finger 5*a*.

Preferably, the driving tooth 31*b* and the first driving finger 5*b* are arranged and/or configured in such a way that, in the driving position of the driving tooth 31*b*, the first driving finger 5*b* exerts, on the driving tooth 31*b*, a mechanical action F seeking to retract the tooth and seeking to drive the first wheel 3. This action F depicted in FIG. 2 (while the first driving finger 5*b* is not in contact with it) in fact seeks to cause the first wheel 3 to rotate in the anti-clockwise direction about the axis A1, and seeks to cause the driving tooth 31*b* to rotate in the clockwise direction about the axis A31. In fact, in the embodiment represented in the specific design, the action is neither orthoradial relative to the axis A1, nor radial relative to the axis A1, but is substantially inclined in relation to these radial and orthoradial directions. The direction of the action F may form an angle between 30° and 60° with the radial and orthoradial directions relative to the axis A1, at the point of application of the action F. The direction of the action F may in particular form an angle equal to or substantially equal to 45° with the radial and orthoradial directions relative to the axis A1, at the point of application of the action F.

The desmodromic system permits the position of the follower to be defined on the basis of the position of the cam without utilizing a spring for the return of the follower against the cam. In other words, the cam controls, by its position relative to the framework, the position of the follower relative to the framework without a spring returning the follower against the cam.

Figure 12:
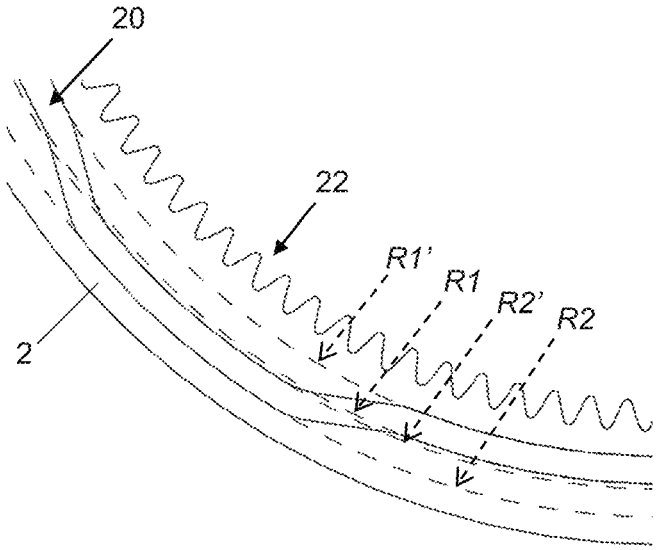
FIGS. 12 and 13 are views of an illustrative embodiment of a cam which is capable of being utilized in the first embodiment.
Figure 13:
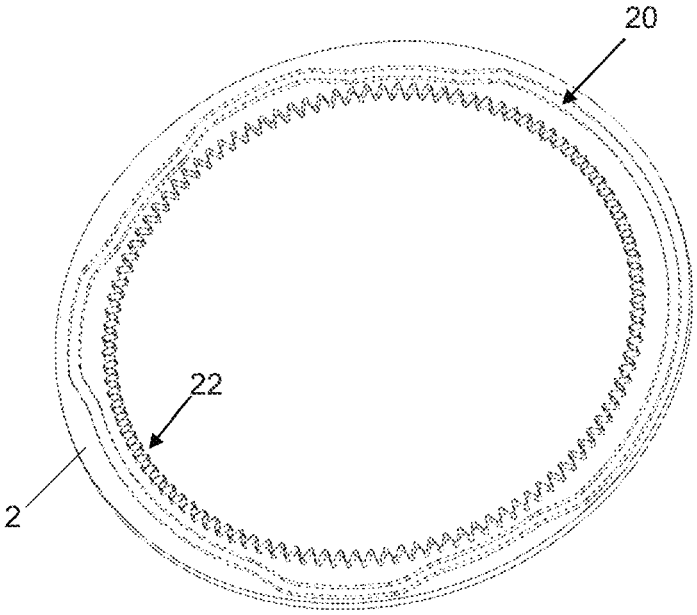

The cam 2 depicted in particular in FIGS. 12 and 13 is preferably a programming cam. For example, the cam has the form of a crown or a ring. The cam is advantageously pivoted on the framework about an axis parallel to the axis A1 or about the axis A1. The cam preferably comprises a cam track 20. Advantageously, this cam track comprises a groove 20. This groove 20 may be implemented along a closed contour. The groove comprises a first flank 20*a* or a first lateral wall and a second flank 20*b* or a second lateral wall. The groove may exhibit first portions realized according to first radii R2 and R2' relative to the axis A1, defining a first follower position and a first driving tooth position 31*b*. The groove may exhibit second portions realized according to second radii R1 and R1' relative to the axis A1, defining a second follower position and a second driving tooth position 31*b*. The groove further comprises connecting portions between the first and second portions.

The first flank 20*a* constitutes a first cam profile. The second flank 20*b* constitutes a second cam profile.

Figure 3:
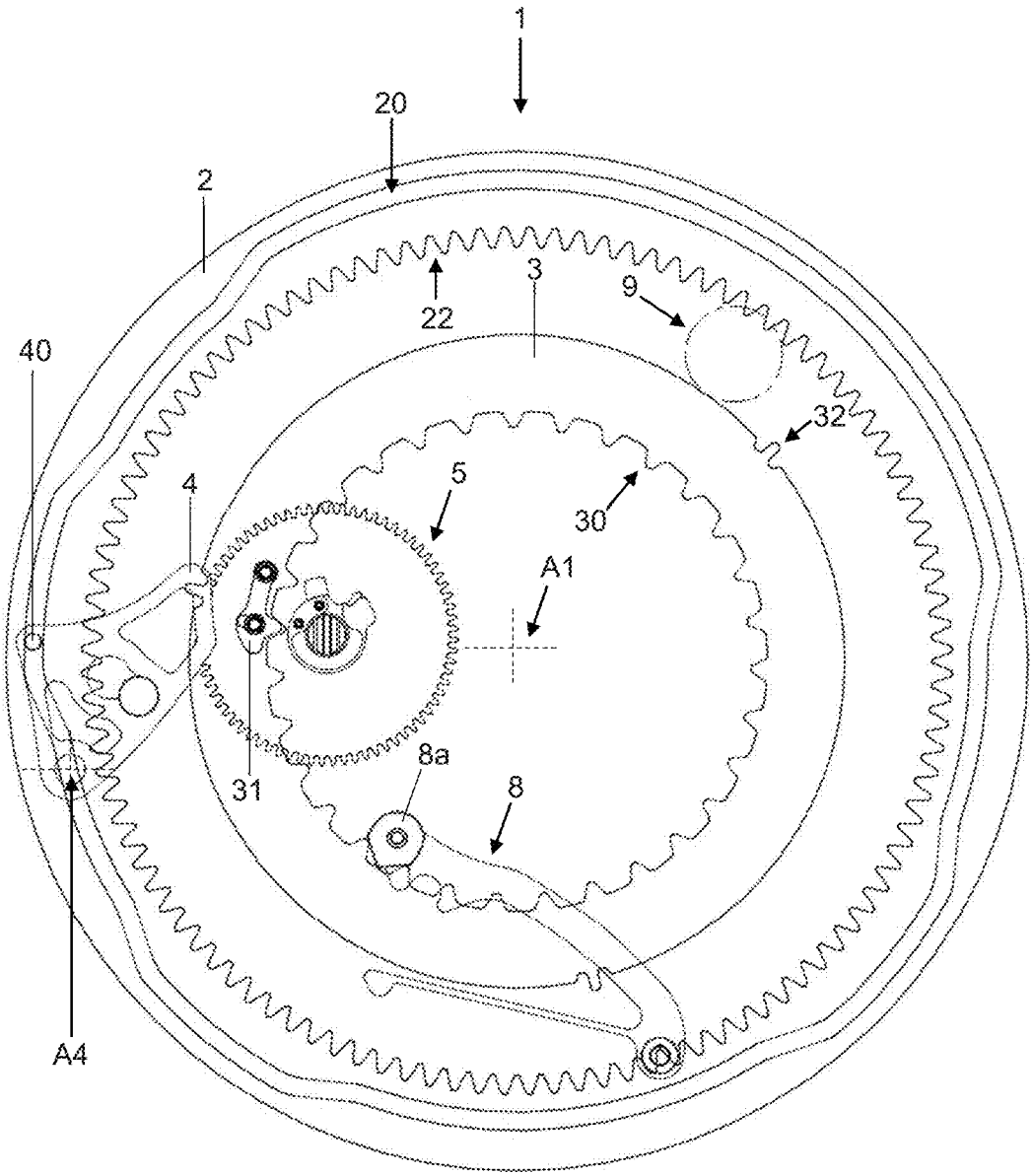

Preferably, the cam 2 is driven in rotation by the rotation of the first wheel 3, in particular by means of an intermediate wheel 9 represented schematically in FIGS. 1 and 3. The intermediate wheel is pivoted, for example, on the framework about an axis A9, in particular about an axis A9 that is parallel or substantially parallel to the axis A1.

In order to do this, the first wheel 3 may be provided with an external toothing 32 comprising at least one tooth, preferably two teeth or three teeth or four teeth or five teeth, and the cam 2 may be provided with an internal toothing 22. The intermediate wheel 9 may be a simple pinion comprising a toothing arranged in such a way as to cooperate both with the toothing 32 and with the toothing 22.

As an alternative, the intermediate wheel may be of the Maltese Cross type, such as to lock the angular position of the cam 2 when the latter is not actuated by the first wheel 3. The intermediate wheel 9 may thus exhibit, for example, a first portion comprising a Maltese Cross and a second portion comprising a pinion. The first and second portions may or may not be separate. Thus, advantageously, the cam 2 may be devoid of any indexation jumper. In fact, the indexation of the first wheel involves the indexation of the cam 2 because of the kinematic connection, in particular the kinematic connection with reduced play, of the first wheel 3 and of the cam 2 by means of the intermediate wheel 9.

The first and second cam profiles 20*a* and 20*b*, in particular at the level of the connection portions between the first and second portions of the groove 20, make it possible to drive the follower respectively in a first direction and a second direction, in such a way that the follower 4 is or is not able to act on the driving tooth 31*b* of the first wheel 3.

Figure 8:
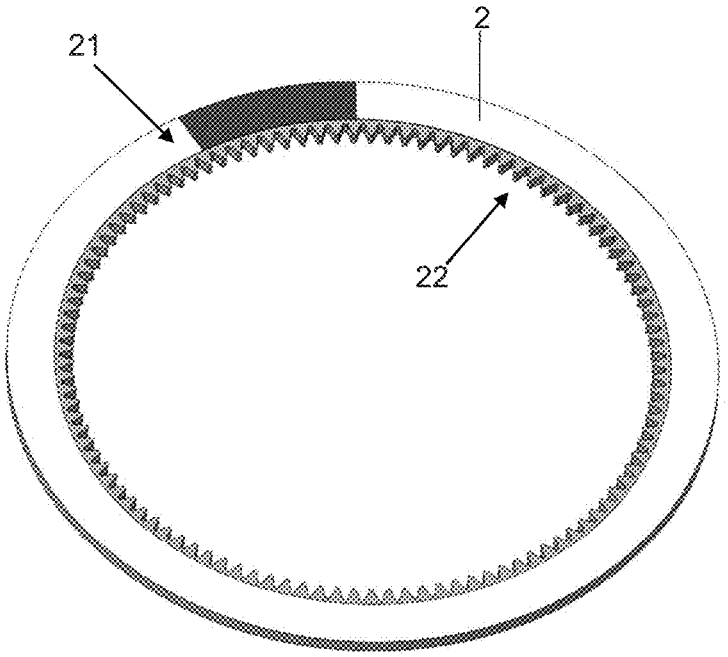

Preferably, the cam 2 carries a device for the display of the indication of the months such as a decal 21 depicted in FIG. 8, for example. This decal 21 may carry one or a plurality of colored markings in order to provide an indication of the current month across one or a plurality of windows of a dial, in particular twelve windows. Alternatively, the cam 2 may carry indications of the months with the help of chains of alphabetical and/or numerical characters appearing, for example, in an aperture provided in the dial of the timepiece.

The follower 4 comprises a pin or a peg 40 intended to be housed in the groove 20.

Preferably, the follower is a lever, in particular a programming lever, pivoted on the framework 99 about an axis A4. The axis A4 is parallel or substantially parallel to the axis A1, for example.

The follower 4 comprises a flank 4*a* arranged in such a way as to prevent, in particular to prevent by positive engagement, the retraction of the driving tooth 31*b* when the follower is in the second position. The driving tooth 31*b* and/or the finger 31 comprises a surface or an abutment 31*a* intended to cooperate by contact with the flank 4*a*.

Figure 5:
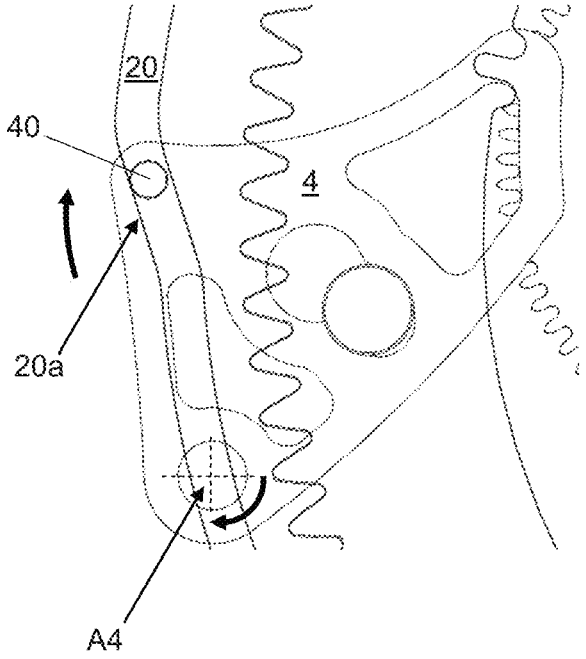
Figure 6:
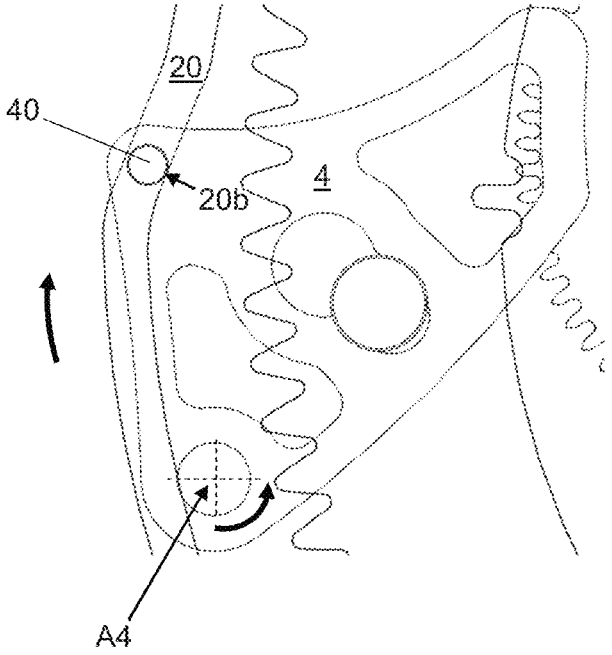

The first cam profile 20*a* is provided in order to act on the peg 40 in such a way that the follower 4 may be driven in a first direction, in particular driven in rotation about the axis A4 in a first direction, in particular the clockwise direction as depicted in FIG. 5. The second cam profile 20*b* is provided in order to act on the peg 40 in such a way that the follower 4 may be driven in a second direction, in particular driven in rotation about the axis A4 in a second direction, in particular the anti-clockwise direction as depicted in FIG. 6.

Advantageously, the angular movement of the follower 4 is limited, or is minimized as far as possible, by the cam profiles 20*a* and 20*b* which serve as an abutment, in particular an angular abutment, when the cam 2 is not actuated. Preferably, the follower 4 further comprises first abutments cooperating with second abutments provided on the framework in such a way as to limit the travel of the follower between the first and second positions. The first and second abutments may comprise at least one groove 4*b* provided in the follower in order to cooperate with a support pin 4*b*' attached, for example, to the framework. As an alternative, the first and second abutments may comprise at least one groove provided in the framework in order to cooperate with a support pin attached, for example, to the follower. The groove and the pin may further constitute means of guiding the follower relative to the framework.

The geometry of the follower 4 may be adapted according to the dimensions of the first wheel 3 and/or of the cam 2, in particular depending on the diameter of the first wheel 3 and/or the diameter of the cam 2. In particular, it is possible to modulate the arrangement of the display of the months independently of the arrangement of the display of the calendar days by means of a given follower 4. For example, for a given calendar day disk 3, it may be possible to arrange different cams 2 supporting display devices for the indication of the month of different dimensions by means of different followers. Thus, the geometry of the follower may be defined in order to cooperate with a calendar day disk of a given geometry and with a cam adapted to display an indication of the month. The geometry of the follower may also be defined in order to cooperate with a cam of a given geometry adapted to display an indication of the month and with a calendar day disk.

A second embodiment of a timepiece 300' is described below with reference to FIGS. 9 to 10. The timepiece is advantageously a watch, for example a wristwatch. The timepiece comprises a watch movement 200'.

The watch movement may be of the electronic type or of the mechanical type, in particular of the automatic type. The watch movement comprises a system 1' for a watch calendar. The calendar system is of the annual type or the semi-perpetual type or the perpetual type, for example. The watch movement and/or the calendar system comprises a framework 99'.

In this second embodiment, an element having a function that is identical or similar to an element of the first embodiment is referenced with the help of the reference for this element in the first embodiment, to which "'" is added.

The second embodiment differs from the first embodiment in that the cam 2' is a wheel. This wheel is pivoted about the axis A1'. The principle of operation of the device according to the second embodiment is identical to that of the device of the first embodiment. Furthermore, FIGS. 9 and 10 illustrate the second embodiment of the timepiece in a configuration similar to that of the first embodiment of the timepiece illustrated in FIGS. 1 and 2.

The cam 2' comprises an external toothing 22' cooperating by meshing with an intermediate wheel 9'.

In this second embodiment, the wheel 2' may be integral with a hand for indicating the months or with a disk for indicating the months. An indexation jumper may possibly be put in place in order to define precisely the angular positioning of the hand or of the disk.

Figure 9:
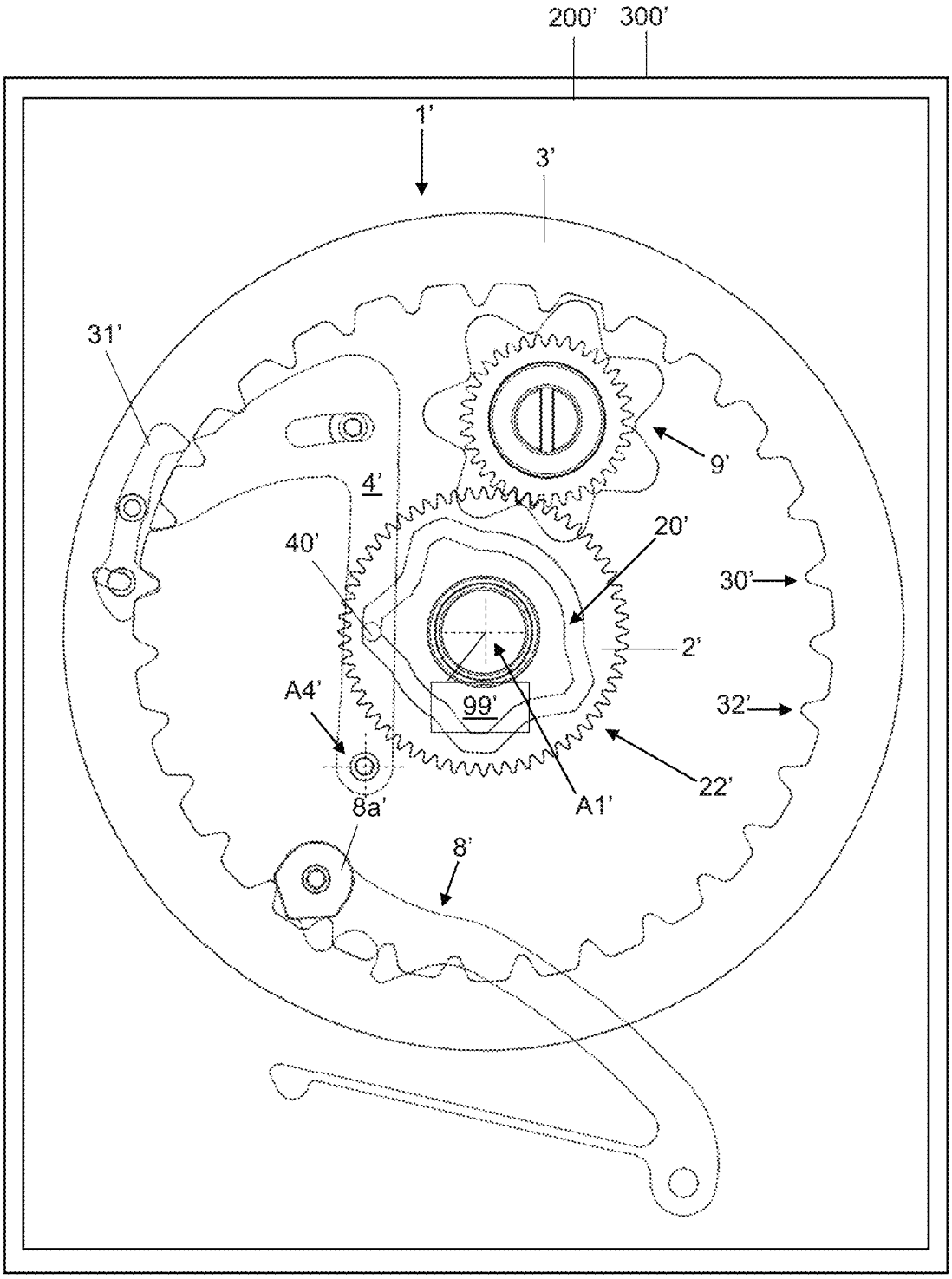
FIGS. 9 and 10 represent a second embodiment of a timepiece.
Figure 10:
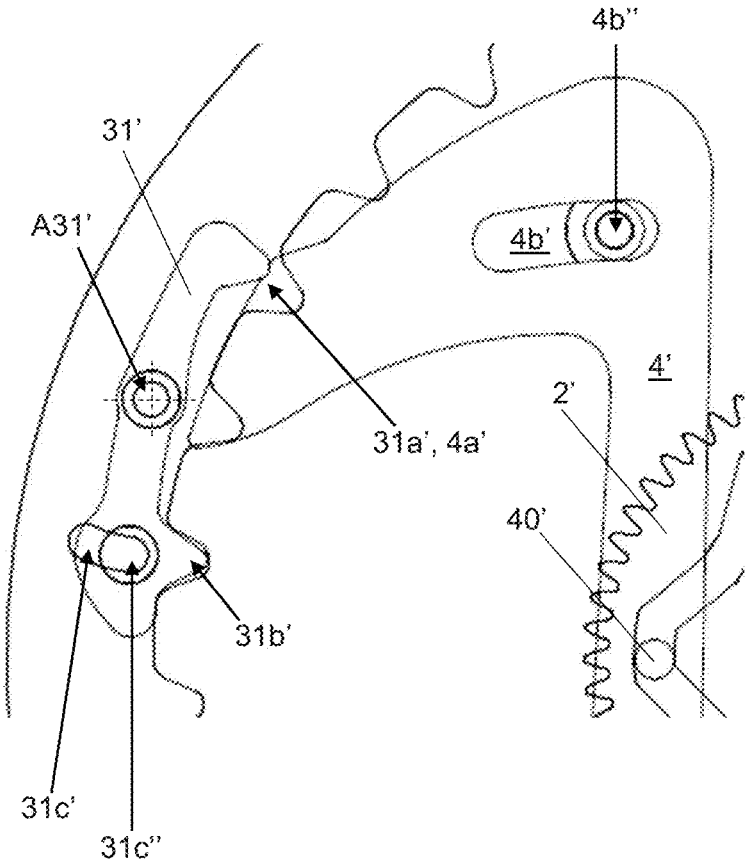

The wheel 5' for driving the first wheel 3' is not depicted in FIGS. 9 and 10.

In the embodiments and variants described previously, the cam comprises a groove of which the flanks constitute first and second cam profiles and the follower comprises a pin cooperating with this groove. However, as an alternative, the cam may comprise a rib, and the follower may comprise a slot, the rib being housed in the slot. The cam profiles are then constituted by the flanks of the rib.

In the embodiments and variants described previously, the driving tooth 31*b* is pivoted on the first wheel. However, the tooth may be movably mounted differently on the first wheel. For example, the driving tooth may be mounted in sliding engagement on the first wheel.

In the embodiments and variants described previously, at the end of the short months, the first driving finger 5*b* acts on the first wheel in order to cause it to advance by one angular step, and the second driving finger 5*a* then acts on the first wheel in order to cause it to advance by a further angular step. At the end of the short months, however, the second driving finger 5*a* may first act on the first wheel in order to cause it to advance by one angular step, and the first driving finger 5*b* may then act on the first wheel in order to cause it to advance by a further angular step.

In the embodiments and variants described previously, the follower is a lever pivoted on the framework. However, the follower may be a slider mounted in sliding engagement on the framework.

In the embodiments and variants described previously, the first and second driving fingers 5*a* and 5*b* are integrated within the same driving wheel. However, the first and second driving fingers 5*a* and 5*b* may be integrated within two separate driving wheels.

In the embodiments and variants described previously, the first and second driving fingers 5*a* and 5*b* are disposed in two parallel and separate planes. However, the first and second driving fingers 5*a* and 5*b*, as well as the driving tooth and the toothing 30, may be in the same plane. In this case, the first driving finger may be shorter than the second driving finger in such a way that the first finger does not interfere with the toothing. The first finger is likewise sufficiently long to act on the driving tooth when it is in the driving position.

In the embodiments and variants described previously, the groove 20 is blind. However, a cutout could separate the cam completely into two cam sections.

In the embodiments and variants described previously, the cam determines only the first and second positions of the follower. Thus, the mobility of the follower may be limited in two opposite directions by the cam. However, the mobility of the peg 40 or the mobility of the follower may, for example, be delimited in at least one direction by an abutment formed on a blank of the movement, for example on the framework 99. The abutment may take the form of a cylindrical wall, for example, of which the radius is equal or substantially equal to Rt. As an alternative or in addition, the abutment may take the form of a cylindrical wall, for example, of which the radius is equal or substantially equal to R2. As a further alternative, the abutment may be one of the abutments constituted by the pin 4*b'*.

A mode of implementation of a method of operation of the timepiece and/or of the movement and/or of the calendar system is described below.

Figure 2:
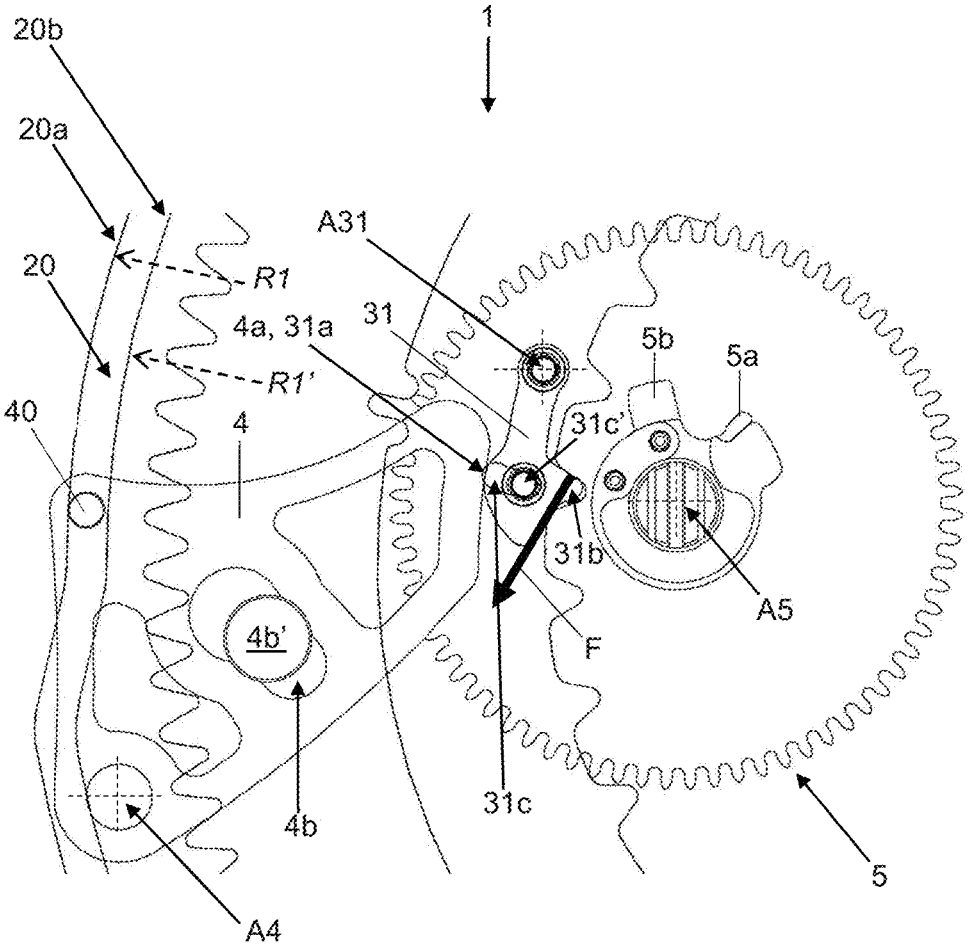

It is assumed that the calendar system is initially in the first state or the first configuration depicted in FIGS. 1 and 2. This configuration corresponds to the thirtieth calendar day of a short month, for example April 30.

In this first configuration, the peg 40 is housed between the two cam profiles 20*a*, 20*b*, which are respectively formed according to two radii R1, R1' of circles centered on the axis A1, in such a way that the flank 4*a* of the follower 4 may cooperate by contact with the surface 31*a* of the driving tooth 31*b*, the follower being in its second position preventing retraction of the driving tooth. Thus, the driving tooth 31*b* may not retract when its head 31*b* is actuated by the application of the force F by means of the first driving finger 5*b* of the driving wheel 5. The contact between the first driving finger 5*b* and the driving tooth 31*b* thus induces the driving of the first wheel 3 by one step. The second driving finger 5*a* of the driving wheel 5 itself induces the driving of the first wheel 3 by a supplementary step. The calendar then indicates May 1.

During the month of May, the cam 2 rotates about the axis A1 in the clockwise direction (according to the figures). During this displacement of the cam, the pin 40 is displaced in the groove 20 and the second cam profile 20*b* acts on the pin in order to displace the follower from its second position preventing retraction of the driving tooth into its first position permitting retraction of the driving tooth. An action of the cam 2 on the follower 4 thus takes place in such a way as to cause it to pass from its second position to its first position. On May 30 or before this date, the follower is in its first position.

FIGS. 3 and 4 illustrate the calendar system in a second configuration corresponding to the thirtieth calendar day of a long month. More specifically, FIGS. 3 and 4 represent the calendar mechanism on May 30.

In this second configuration, the peg 40 is still housed between the two cam profiles 20*a*, 20*b*, which are respectively formed according to two radii R2, R2' of circles centered on the axis A1, in such a way that the flank 4*a* of the follower 4 is no longer able to cooperate by contact with the surface 31*a* of the driving tooth 31*b* in such a way that it interferes with the first driving finger 5*b* as it rotates about the axis A5. The follower is in its first position, in which it permits retraction of the driving tooth. Thus, if the driving tooth 31*b* is in a position of interference with the trajectory of the first driving finger 5*b*, it will be subjected to the force F applied by the first driving finger 5*b* of the driving wheel 5. Under the effect of this force F, the driving tooth 31*b* is retracted as it rotates in the clockwise direction about the axis A31. The possible contact between the first driving finger 5*b* and the driving tooth 31*b* thus does not induce driving of the first wheel 3. The second driving finger 5*a* of the driving wheel 5 itself induces the driving of a step of the first wheel 3. The calendar then indicates May 31.

From this date and/or over the month of June, the cam 2 rotates about the axis A1 in the clockwise direction (in the figures). During this displacement of the cam, the pin 40 is displaced in the groove 20 and the first cam profile 20*a* acts on the pin in order to displace the follower from its first position permitting retraction of the driving tooth into its second position preventing retraction of the driving tooth. An action of the cam 2 on the follower 4 is thus produced in such a way as to cause it to pass from its first position into its second position. On June 30 or before this date, the follower in once again in its second position.

As described previously, when the follower is in its second position, the first driving finger 5*b* exerts a mechanical action F on the driving tooth 31*b* for driving the first wheel, since the retraction of the cam is prevented here, and, when the follower is in its first position, the first driving finger 5*b* exerts a mechanical action on the driving tooth 31*b* for the retraction of the driving tooth 31*b* without driving the first wheel 3, since the retraction of the tooth takes place without resistance, whereas the jumper 8 induces a resistance to the driving of the first wheel. The follower, the tooth and the first finger are thus arranged and/or configured in such a way that, in the driving position of the tooth, the first finger exerts a mechanical action on the tooth retracting the tooth or a mechanical action driving the first wheel. The consequence of this mechanical action differs according to the position of the follower.

The solutions described previously make it possible to minimize the number of springs utilized to display the calendar information. The energy utilized to display the calendar information may thus be minimized. In particular, the energy accumulated in the calendar system is limited. The limitation of the energy consumption makes it possible to limit the disturbances of the balance wheel and hairspring oscillator with the ability to have an adverse effect on the accuracy of the timepiece.

These solutions are particularly simple to implement. Furthermore, these solutions advantageously permit the modulation the display of the indication of the months, in particular having regard for that of the calendar days. This may be realized independently of any additional return spring or indexing spring.

The invention claimed is:

1. A system for a watch calendar, the system comprising:

a first wheel;

a first finger for driving the first wheel;

a tooth for driving the first wheel, the tooth being movably mounted on the first wheel between a retracted position and a driving position; and a desmodromic system comprising a cam and a cam follower, the desmodromic system being arranged so that at least a first position of the cam defines a first position of the follower permitting the retraction of the tooth, and so that at least a second position of the cam defines a second position of the follower preventing the retraction of the tooth; and further including at least one of:

a) wherein the system comprises an intermediate wheel arranged so that the cam is driven by the movement of the first wheel, the intermediate wheel comprising elements of the kinematic connection of the cam to the first wheel; and b) wherein the cam comprises elements for the display of information pertaining to the month.

2. The system for a watch calendar as claimed in claim 1, wherein the follower, the tooth and the first finger are arranged and/or are configured so that, in the driving position of the tooth, the first finger exerts, on the tooth, a mechanical action retracting the tooth or driving the first wheel.

3. The system for a watch calendar as claimed in claim 1, wherein the tooth is pivoted on the first wheel about a first axis or wherein the tooth is mounted in sliding engagement on the first wheel.

4. The system for a watch calendar as claimed in claim 1, wherein the system comprises a framework and wherein the follower is a lever pivoted on the framework about a second axis or the follower is a slider mounted in sliding engagement on the framework.

5. The system for a watch calendar as claimed in claim 1, wherein the follower comprises a flank arranged so as to prevent the retraction of the tooth when the follower is in the second position.

6. The system for a watch calendar as claimed in claim 5, the flank is arranged to prevent the retraction of the tooth when the follower is in the second position by positive engagement.

7. The system for a watch calendar as claimed in claim 1, wherein at least one selected from the group consisting of:

(i) the first wheel is a calendar day wheel, (ii) the cam is a crown or a wheel comprising a groove and the follower comprises a pin or a peg housed in the groove, and (iii) the cam is a crown or a wheel comprising a rib and the follower comprises a pin or a peg equipped with a slot, the rib being housed in the slot.

8. The system for a watch calendar as claimed in claim 7, wherein the first wheel is a calendar day disk.

9. The system for a watch calendar as claimed in claim 1, wherein at least one selected from the group consisting of:

(i) the follower comprises first abutments cooperating with second abutments provided on a framework in such a way as to limit the travel of the follower between the first and second positions, and (ii) the tooth comprises third abutments cooperating with fourth abutments provided on the first wheel in such a way as to limit the travel of the tooth between the retracted position and the driving position.

10. The system for a watch calendar as claimed in claim 1, wherein at least one selected from the group consisting of:

(i) the first wheel comprises a toothing having 31 teeth, and (ii) the system comprises a second driving wheel, of which a second finger is arranged in such a way as to drive the first wheel.

11. The system for a watch calendar as claimed in claim 10, wherein the second driving wheel comprises the first finger.

12. The system for a watch calendar as claimed in claim 1, wherein said at least one of a) and b) includes that the system comprises an intermediate wheel arranged so that the cam is driven by the movement of the first wheel, the intermediate wheel comprising elements of the kinematic connection of the cam to the first wheel.

13. The system for a watch calendar as claimed in claim 12, wherein the elements of the kinematic connection of the cam to the first wheel include a first toothing cooperating with a toothing of the cam and a second toothing cooperating with a toothing of the first wheel.

14. The system for a watch calendar as claimed in claim 1, wherein said at least one of a) and b) includes that the cam comprises elements for the display of information pertaining to the month.

15. The system for a watch calendar as claimed in claim 14, wherein the elements for the display of information pertaining to the month include characters.

16. The system for a watch calendar as claimed in claim 14, wherein the elements for the display of information pertaining to the month include a decal intended to cooperate with a dial.

17. The system for a watch calendar as claimed in claim 16, wherein the elements for the display of information pertaining to the month include a decal intended to cooperate with one or a plurality of apertures of the dial.

18. The system for a watch calendar as claimed in claim 14, wherein the elements for the display of information pertaining to the month include the cam being integral with an element for indicating a month.

19. The system for a watch calendar as claimed in claim 18, wherein the element for indicating a month includes a hand integral with the cam.

20. The system for a watch calendar as claimed in claim 19, wherein the cam includes a wheel.

21. A watch movement comprising a system as claimed in claim 1.

22. A timepiece comprising a system as claimed in claim 1.

23. A method of operation of a system for a watch calendar as claimed in claim 1, the method comprising:

acting by the cam on the follower so as to cause the follower to pass from the first position to the second position, and acting by the cam on the follower so as to cause the follower to pass from the second position to the first position.

24. The method of operation of a system for a watch calendar as claimed in claim 23, wherein, when the follower is in the second position, the first finger exerts, on the tooth, a mechanical action for driving the first wheel, and wherein, when the follower is in the first position, the first finger exerts, on the tooth, a mechanical action for the retraction of the tooth without driving the first wheel.

* * * * *